US005147693A

United States Patent [19]

Communal et al.

[11] Patent Number: 5,147,693

[45] Date of Patent: Sep. 15, 1992

[54] BIOLOGICALLY STABLE, UNTANNED WET ANIMAL HIDES

[75] Inventors: Jean-Pierre Communal, La Varenne Saint Hilaire; Gerard Gavend, Lyons, both of France

[73] Assignee: Rhone-Poulenc Chimie, Courbevoie, France

[21] Appl. No.: 559,337

[22] Filed: Jul. 30, 1990

[30] Foreign Application Priority Data

Jul. 28, 1989 [FR] France ..... 89 10193

[51] Int. Cl.[5] ..... B37B 3/00

[52] U.S. Cl. ..... 428/22; 428/473; 8/94.15

[58] Field of Search ..... 428/473, 22; 8/94.15

[56] References Cited

U.S. PATENT DOCUMENTS 2,009,255 7/1935 Friestedt ..... 428/473
4,185,011 1/1980 Eckmayer et al. ..... 260/123.7
4,272,242 6/1981 Plapper et al. ..... 8/94.15
5,011,679 4/1991 Spanier ..... 424/57

FOREIGN PATENT DOCUMENTS 1207107 7/1986 Canada ..... 8/94.15

*Primary Examiner*—Patrick J. Ryan
*Assistant Examiner*—Kam F. Lee
*Attorney, Agent, or Firm*—Burns, Doane, Swecker & Mathis

[57] ABSTRACT

Biologically stable, fungistatic and bacteriostatic, untanned wet animal hides intrinsically insensitive to mildews, devoid of coloration and chromium values and containing from 50% to 70% of water, from 5% to 30% of inorganic matter, from 0.5% to 1.5% of $Al_2O_3$ and from 85% to 90% of dermal material, are produced by impregnating pickled hides with a basic aluminum polychloride or polychlorosulfate and then alkalyzing the medium of impregnation.

3 Claims, No Drawings

BIOLOGICALLY STABLE, UNTANNED WET ANIMAL HIDES

BACKGROUND OF THE INVENTION

1. Field of the Invention

The present invention relates to biologically stable, untanned hides in wet state, designated B.S.H. or W.S.W.H. ("Wet Stabilized White Hide").

2. Description of the Prior Art

Commercially, hides are marketed in various forms:

(i) in the crude or raw state (saline-cured, brine-cured, saline-cured/dry and fresh, and the like);

(ii) in the pickled state (treatment with a solution of strong acid in the presence of salt);

(iii) in the tanned state (especially "wet-blue" treatment with chrome);

(iv) in the semi-finished (stain) state; or (v) in the finished state.

Depending on their particular form, hides in the raw state present problems of saline pollution, of rewetting, etc. As regards pickled hides, these are fragile because they have not been subjected to any chemical treatment and must be protected against swelling.

The presentation of hides in wet-blue form is not free of disadvantages, especially from the standpoint of the ecology; indeed, without using additional adjuvants and/or of adapted operating techniques for removing chrome, the discharged effluent solutions have a high chromium concentration emanating from the tanning baths themselves and then from the retanning operations (displacement by the retanning agents).

In addition, up to 40% of the chrome baths is lost in the form of solid wastes during the splitting and shaving operations.

It has been proposed to this art (French Patent No. 2,239,525), to reduce the chromium concentration in the effluents, upstream of the chrome tanning operation, to treat such hides for 10 to 12 hours at a pH on the order of 3.9 to 4.2 with basic aluminum polychloride in an amount, expressed as $Al_2O_3$, corresponding to 1% to 4% of the weight of the hide to be treated.

This entails a true irreversible pretanning operation, since it considerably modifies the collagen molecules.

For about ten years, the leather industry has sought to provide novel products constituting an intermediate stage of preconditioning of the hides after pickling; these products present a number of advantages:

(a) they are free from chromium;

(b) they are capable of withstanding the splitting and shaving operations (intended to produce leathers for different markets) before the tanning operations; these splitting and shaving operations carried out on such novel products, therefore, permit avoiding the production of chromium-containing solid wastes;

(c) the existing faults in the hides can be detected very early in the leather conversion line, and this permits a better choice and a better distribution of hides depending on their quality and the market requirements;

(d) the manufacturing rejects consisting of hides of inadequate thickness and all wastes can be reclaimed by conversion into industrial gelatin and into food-grade collagen, since they do not contain any chromium;

(e) they make it possible to offer a hide whose stability is easily reversible; indeed, after removal of the stabilizing agents, these materials are equivalent to the original pickled hide because the collagen becomes again available for conventional tanning operations;

(f) their shrinkage temperature and stability over time are high, permitting them to be stored for a long period of time under difficult conditions (for example in transport over long distances for several months).

These novel products are designated "Wet Stabilized White Hide" (W.S.W.H. or B.S.H.) when they are wet, or "Dry Stabilized White Hide" (D.S.W.H. or B.S.S.) when they are dry (see French Patent No. 2,610,643).

SUMMARY OF THE INVENTION

A major object of the present invention is the provision of wet hides devoid of coloration, biologically stable, untanned, completely free from chromium, containing from 50% to 70%, preferably from 55% to 65%, by weight of water, from 5% to 30%, preferably from 7% to 12%, by weight of total inorganic matter relative to the dry and degreased leather, from 0.5% to 1.5%, preferably less than 1%, by weight of $Al_2O_3$ relative to the dry and degreased leather and from 85% to 90% by weight of dermal material relative to the dry and degreased leather; these novel wet hides are intrinsically insensitive to mildews without any addition of complementary fungistatic and bacteriostatic agents.

DETAILED DESCRIPTION OF THE PREFERRED EMBODIMENTS OF THE INVENTION

More particularly according to the present invention, the subject WSWHs can be prepared by impregnating pickled hides at a pH on the order of 3 to 4, preferably on the order of 3.5 to 3.8, with a bath based on basic aluminum polychloride or on a basic aluminum polychlorosulfate, in an amount corresponding to 0.08% to 0.45%, preferably 0.10% to 0.25% by weight of $Al_2O_3$ relative to the weight of the pelt hide, then alkalizing to a final pH on the order of 4 to 4.4 and optional wringing.

The pickled hides are obtained from various animal species such as sheep, goats, bovines, etc., and are prepared by picking according to the usual techniques for pickling hides which have been subjected to the conventional stream operations (dressing, dehairing, bating, drenching).

Exemplary basic aluminum polychlorides and basic aluminum polychlorosulfates include those of the formula:

$$Al_n(OH)_mCl_{3n-m} \quad (I)$$

wherein n and m are any positive integers and $3n-m$ is positive;

$$Al(OH)_mCl_{3-m-2n}(SO_4)_n \quad (II)$$

wherein m ranges from 1.1 to 2.1 and n ranges from 0.12 to 0.18; its basicity ranges from 0.37 to 0.70. These compounds are described in French Patent No. 2,239,525;

$$Al_n(OH)_mCl_{3-n-m-2k}(SO_4)_k \quad (III)$$

wherein k, m and n are positive integers and $3n>m+2k$ and $k/n=0.01$ to 0.3; its basicity m/3n ranges from 0.3 to 0.7. These compounds are described in U.S. Pat. No. 3,929,666;

$$[Al_n(OH)_{3-n-m-2p}Cl_m(SO_4)_p]_z \quad (IV)$$

wherein $(3n-m-2p)/3n=0.4$ to 0.7, $p=0.04$ to 0.25 n, $m/p=8$ to 35, m, n and p being integers and z is equal to at least 1. These compounds are described in British Patent No. 2,128,977; and $$Al_n(OH)_m(SO_4)_kCl_{3n-m-2k} \quad (V)$$

wherein the basicity m/3n ranges from 0.40 to 0.65, the Al equivalent/Cl equivalent ratio ranges from 2.8 to 5, the weight-average molecular weight $\overline{M}w$ ranging from 10,000 to 500,000, preferably from 10,000 to 300,000, and the real hydrodynamic diameters $\phi Z$ and $\phi W$ having the following values:

$\phi Z$=from 90 to 450 Å, $\phi W$=from 50 to 300 Å.

These compounds are described in published European Application No. 218,487.

The basic aluminum polychlorides or basic aluminum polychlorosulfates may be employed in the form of aqueous solutions containing 4–20% by weight of active material, expressed as $Al_2O_3$, or in the form of a pulverulent solid.

The impregnation operation may be carried out at normal temperatures (for example 10° to 35° C.) in a fuller with an adjustable speed of rotation and providing the option of heating the impregnating bath.

The alkalation operation is then carried out, for example with the aid of sodium bicarbonate or carbonate, magnesium oxide, dolomite, etc., in sufficient amount to provide a bath pH on the order of 4 to 4.4.

It is determined that, quite unexpectedly and surprisingly, the product obtained shows little sensitivity to mildews, this being without the addition of fungistatic or bacteriostatic agents. Thus, after 7 weeks of storage at 35° C., the WSWHs of the invention still exhibit no mildews.

A preferred embodiment of the impregnation operation which makes it possible to prevent any accidental mildew phenomenon entails introducing into the treatment bath from 0.5% to 5% by weight relative to the weight of pelt of a vinylic acid such as methacrylic, allylic and especially acrylic and/or from 0.02% to 1.25% by weight (expressed as the oxide) relative to the weight of pelt of one of their metal salts (of rare earths of the lanthanum, cerium or similar type, of zinc, nickel, etc.) and especially of lanthanum acrylate.

Finally, it has also been determined that these vinylic acids, or metal salts thereof, strengthen the antifungal activity of the treatment bath based on basic aluminum polychloride or polychlorosulfate.

These vinylic acids or salts thereof can be removed or converted for the subsequent use of the wastes, by polymerization with the aid of a redox pair, of X-rays, and the like.

Although they are not necessary, the antifungal agents which are typically employed in the treatment of hides can be additionally introduced into the impregnating bath (derivatives of chlorinated phenols, benzothiazoles or isothiazolones).

The WSWHs of the invention have particularly good rewettability properties which make it possible, especially in the case of small hides (goats, sheep), to avoid using any rewetting agent (surfactants of the sulfonate, amine, amine salt and similar types) for converting them into a dry stabilized DSWH hide. The WSWHs of the invention are simply introduced for rewetting into a fuller in the presence of water with minimum mechanical working, such as to avoid damaging the hides by abrasion.

The WSWH of the invention is readily reversible; indeed, it can be reconverted into raw hide by an acidic treatment in a fuller (for example using an aqueous solution of hydrochloric, sulfuric or similar acid) in order to remove the aluminum salts.

The WSWHs of the present invention have a minimum shrinkage temperature of at least 60° C., typically on the order of 64° to 68° C., wholly compatible with the splitting and shaving operations.

The WSWHs can then be subjected to the traditional tanning operations: chrome tanning with a better chrome bath exhaustion, since the WSWH contains aluminum salts, synthetic tanning, vegetable tanning, or combinations of these various types of tanning.

In order to further illustrate the present invention and the advantages thereof, the following specific examples are given, it being understood that same are intended only as illustrative and in nowise limitative.

EXAMPLE 1

Calf bends which had undergone stream operations (dressing, dehairing, bating and drenching) were subjected to pickling and stabilizing operations according to the invention.

The apparatus employed was an 800-liter wooden fuller with an adjustable speed of rotation. The percentages referred to are by weight and are calculated on the weight of the pelt unless otherwise indicated:

Pickling: speed of rotation from 6 to 8 revolutions/min.

The bends were treated in the following baths:

(1)

Cold water (18020° C.): 25%
Sea salt: 5%
Rotation: 5 min
Bath density: 1.04 to 1.07 g/cm$^3$ (2)

addition of 1.5% of sulfuric acid in the form of a 10% strength aqueous solution
Rotation: 30 min (3)

addition of 0.7% of sodium formate in the form of a 10% strength aqueous solution
Rotation: 3 hours.

The pH of the resulting bath was 3.4.

Impregnation: speed of rotation 6 to 8 revolutions/min.

To the bath was added 2% (namely, 0.16% expressed as $Al_2O_3$) of aqueous aluminum polychlorosulfate solution exhibiting a basicity of 55%, a degree of desulfation of 82% and an $Al_2O_3$ content of 8.3%, prepared according to the process described in published European Patent Application No. 218,487.

The mixture was rotated for 2 hours.

The pH of the resulting bath was 3.6.

Alkalation 0.6% of sodium bicarbonate in the form of a 10% strength aqueous solution was added to the bath.

The mixture was rotated for 1 h, 30 min.

The pH of the bath was 4.1.

The WSWH hide thus obtained was wrung under low pressure ($5\times10^5$ Pa).

The wrung WSWH contained:

(i) 60% of its weight of water;

(ii) 10% of its weight (relative to dry matter according to NF standard G 52 202) of inorganic matter;

(iii) 0.80% of its weight (relative to dry matter) of $Al_2O_3$;

(iv) 85% of its weight (relative to dry matter) of dermal materials.

Its shrinkage temperature, measured according to NF standard G 52 012, was 67° C.

No mildew was detected after 7 weeks of storage at 32°/35° C. and 80–85% relative humidity.

Conversion into wet blue

The percentages referred to below are by weight and were calculated on the weight of wrung WSWH $\times1.5$ (to obtain a percentage equivalent to that expressed relative to the pelt).

The wrung and stored WSWH bends were then shaved to 1.8 mm without difficulty and subjected to rewetting, acidifying, tanning and alkalation operations in a fuller similar to that described above.

Rewetting: Speed of rotation from 6 to 8 revolutions/min.

Cold water (16°–18° C.)=10%;
Rotation: 10 min, followed by draining.

Acidifying: speed of rotation from 6 to 8 revolutions/min.

Cold water (16°–18° C.)=40%;
NaCl=4%;
Rotation: 10 min;
pH of the bath=4.0;
Bath density: 1.04 to 1.07 g/cm$^3$.
0.5% of sulfuric acid in the form of a 10% strength aqueous solution was then added:
Rotation: 20 min.

The pH of the resulting bath was 3.2.

Tanning: speed of rotation from 8 to 10 revolutions/min.

8% of chromium sulfate in the form of a 25% strength aqueous solution was added to the bath:

Rotation: 6 hours.

The pH of the resulting bath was 3.2 to 3.3.

Alkalation: speed of rotation 8 to 10 revolutions/min.

The following materials were added to the bath:

(i) 0.5% of sodium bicarbonate in the form of a 10% strength aqueous solution;

(ii) rotation: 15 min, the pH obtained was 3.6;

(iii) then again, 0.5% of sodium bicarbonate in the form of 10% strength aqueous solution;

(iv) rotation: 60 min, the pH obtained was 3.9.

The wet blues obtained were recovered and placed on a rack.

Conversion of the wet blue into stain

The percentages referred to below were calculated on the weight of the blue.

The bends ex WSWH chrome tanned in the preceding operation were subjected to the following operations:

Washing: speed of rotation 8 to 10 revolutions/min.

Cold water (16°–18° C.): 150%;
Rotation: 5 min, then draining.

Retanning-neutralizing: speed of rotation 8 to 10 revolutions/min.

Water at 35° C.: 100%;
Synektan N.C.R. (organometallic tannin marketed by ICI): 4%;
Rotation: 30 min.

Then, 2% of Neutraktan D (neutralizing agent marketed by ICI) was added:
Rotation: 1 h.

The pH of the bath obtained was 5.4.

After draining, the product was washed with 100% of water at 40° C.:
Rotation: 5 min.

Retanning: speed of rotation 8 to 10 revolutions/min.

Water at 40° C.: 50%;
Albatan SF (synthetic tannin marketed by Rhône-Poulenc): 8%;
Rotation: 45 min, then draining.

Feeding: speed of rotation 8 to 10 revolutions/min.

Water at 60° C.: 50%;
Lipoderm-licker PK (sulfite-treated oil of animal origin marketed by BASF): 6%;
Rotation: 45 min.

The stains obtained were recovered and placed on a rack for 24 h.

After wringing and drying, it was found that the product obtained contained 0.132% of fixed $Al_2O_3$ (expressed relative to dry matter).

The WSWH itself contained 0.80% of $Al_2O_3$, expressed relative to dry matter.

It was therefore concluded that most of the $Al_2O_3$ had been removed by displacement by the tanning agents during the conversion into wet blue and into stain; this was due to the reversibility of the WSWH.

EXAMPLE 2

The pickling, impregnating and alkalation operations described in Example 1 were repeated, the impregnation being carried out using 2.2% of an aqueous solution of basic aluminum polychlorosulfate.

After 2 hours of rotation, 1.1% of acrylic acid, expressed relative to the weight of the pelt, was added.

After 2 hours of rotation, the mixture was alkalized as before to pH 4.

No mildew was detected after 11 weeks of storage at 32°–35° C. and 80–85% relative humidity.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A biologically stable, fungistatic and bacteriostatic, untanned wet animal hide, having a shrinkage temperature of about 64° to 68° C., and intrinsically insensitive to mildews, said wet animal hide being devoid of coloration and chromium values and comprising from 50% to 70% by weight of water, from 50% to 30% by weight of total inorganic matter relative to the dry and degreased leather, from 0.5 to 1.5% by weight of $Al_2O_3$ relative to the dry and degreased leather, and from 85% to 90% by weight of dermal material relative to the dry and degreased leather.

2. The untanned wet animal hide as defined by claim 1, comprising from 55% to 65% by weight of water, from 7% to 12% by weight of total inorganic matter, and less than 1% by weight of $Al_2O_3$.

3. The biologically stable, fungistatic and bacteriostatic, untanned wet animal hide of claim 1 which has been produced by a process comprising;

impregnating a pickled animal hide at a pH ranging from about 3 to 4, with a treatment bath which comprises a basic aluminum polychloride or polychlorosulfate in an amount corresponding to 0.08% to 0.45% by weight of $Al_2O_3$ relative to the weight of the pelt, and then alkalizing the treatment medium to a final pH ranging from about 4 to 4.4.

* * * * *